US006420737B1

(12) United States Patent
Fan

(10) Patent No.: US 6,420,737 B1
(45) Date of Patent: Jul. 16, 2002

(54) EXTERNAL INFRARED RAYS CONTROL SWITCH DEVICE FOR CONTROLLING OUTPUT WATER ON FAUCETS

(76) Inventor: Huan-Chang Fan, 9-1, Hsin-Sheng Rd., Miao-Li Hsien (TW)

( * ) Notice: Subject to any disclaimer, the term of this patent is extended or adjusted under 35 U.S.C. 154(b) by 24 days.

(21) Appl. No.: 09/759,502

(22) Filed: Jan. 16, 2001

(51) Int. Cl.[7] ..... F16K 31/00; F16K 31/02

(52) U.S. Cl. ..... 257/129.04; 257/129.15; 257/291

(58) Field of Search ..... 251/129.04, 291, 251/129.15; 4/623

(56) References Cited

U.S. PATENT DOCUMENTS 5,173,178 A * 12/1992 Kawashima et al. ..... 137/801
5,224,509 A * 7/1993 Tanaka et al. ..... 137/315.03
5,577,660 A * 11/1996 Hansen ..... 236/12.12
5,694,653 A * 12/1997 Harald ..... 4/559
5,797,417 A * 8/1998 DeLattre et al. ..... 137/624.12
5,868,311 A * 2/1999 Cretu-Petra ..... 236/12.12
6,250,901 B1 * 6/2001 Kolar et al. ..... 251/129.04

* cited by examiner

*Primary Examiner*—Lesley D. Morris
*Assistant Examiner*—D A Bonderer
(74) *Attorney, Agent, or Firm*—Charles E. Baxley

(57) ABSTRACT

A switch device for faucet includes a casing having a connection port on a top surface thereof so as to be externally connected to an outlet of the faucet and an outlet member is located on an underside of the casing. A solenoid valve is received in the casing and connected with the output member. A battery set is received in a first side of the casing and an infrared rays sensing device is received in a second side of the casing. A button is connected to the top surface of the casing and electrically connected to the solenoid valve so that the water flows continuously by pressing the button.

6 Claims, 6 Drawing Sheets

EXTERNAL INFRARED RAYS CONTROL SWITCH DEVICE FOR CONTROLLING OUTPUT WATER ON FAUCETS

FIELD OF THE INVENTION

The present invention relates to a switch device controlled by infrared rays and the device is externally connected to the faucet.

BACKGROUND OF THE INVENTION

A conventional switch device controlled infrared rays for faucet is generally installed on a root portion of the faucet for public use and includes a large sensing device and activating device. The conventional switch device has to be cooperated with faucets with special specification so that only a sensing part of the sensing device is located above the wash bowl. The users have to put their hands in front of the sensing part to activate the switch to open the valve in the switch device in the faucet. Once the users' hand is removed from the sensing device, the valve is automatically stopped and no water flows from the faucet. By this way, water is not wasted. The conventional switch device is not suitable for use on faucet in home because it occupies a large space and the faucet in home generally has a simple structure that cannot cooperated with the switch device. Besides, there are a hot water valve and a cold water switch for the home-use faucet and the conventional switch device can only control one valve.

The present invention intends to provide a switch device controlled by infrared rays that is externally connected to the faucet in home.

SUMMARY OF THE INVENTION

In accordance with one aspect of the present invention, there is provided a switch device for faucet and including a casing with connection port on a top surface thereof so as to be externally connected to an outlet of the faucet. An outlet member is located on an underside of the casing and a solenoid valve is received in the casing and connected with the output member. A battery set is received in a first side of the casing and an infrared rays sensing device is received in a second side of the casing. Water flows from the outlet member when an object is located to be sensed by infrared rays sensing device.

The primary object of the present invention is to provide a switch device controlled by infrared rays and the switch device can be externally connected to the faucet in home.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
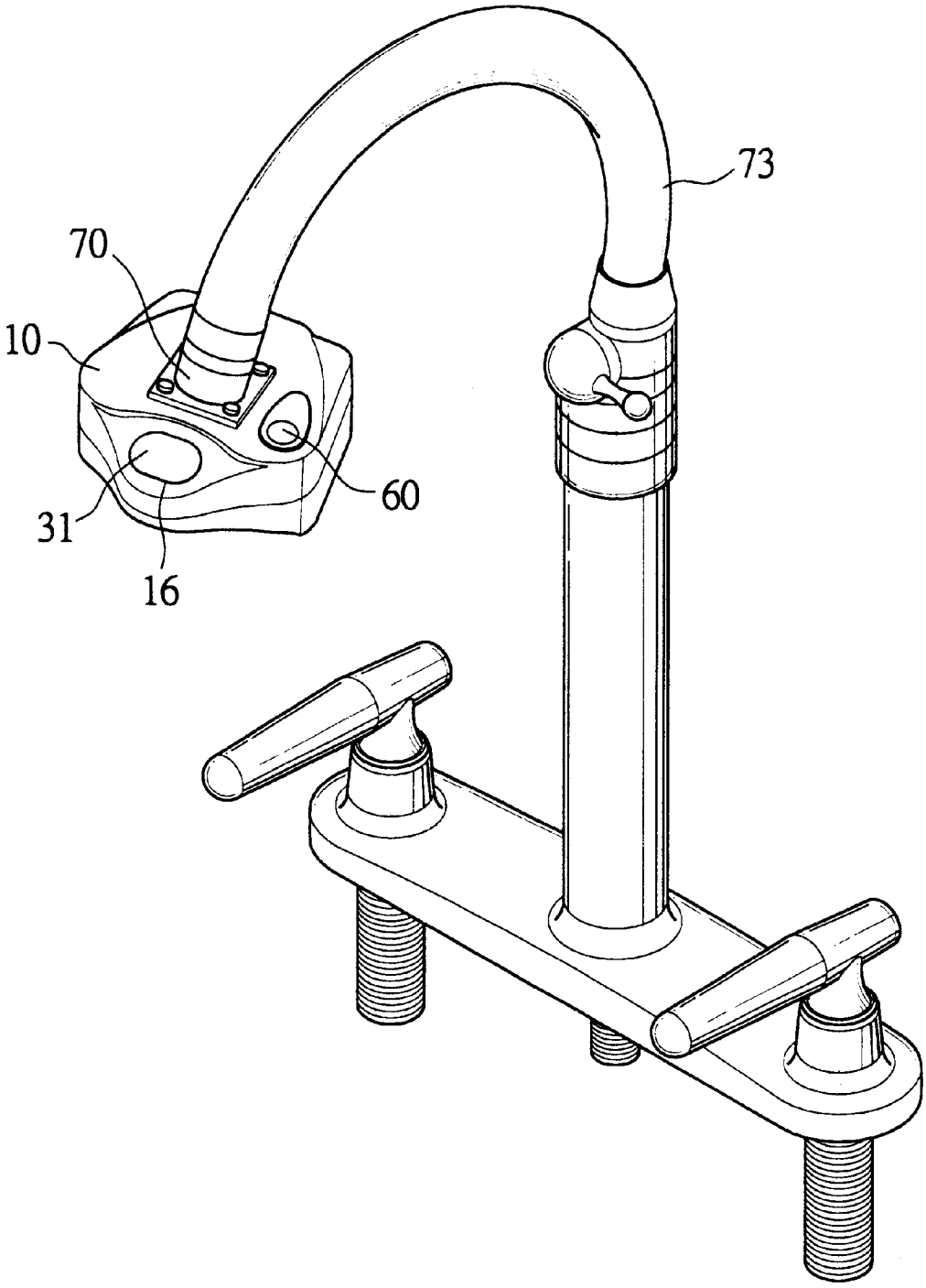
FIG. 1 is a perspective view to show the switch device of the present invention is externally connected to a faucet.
Figure 2:
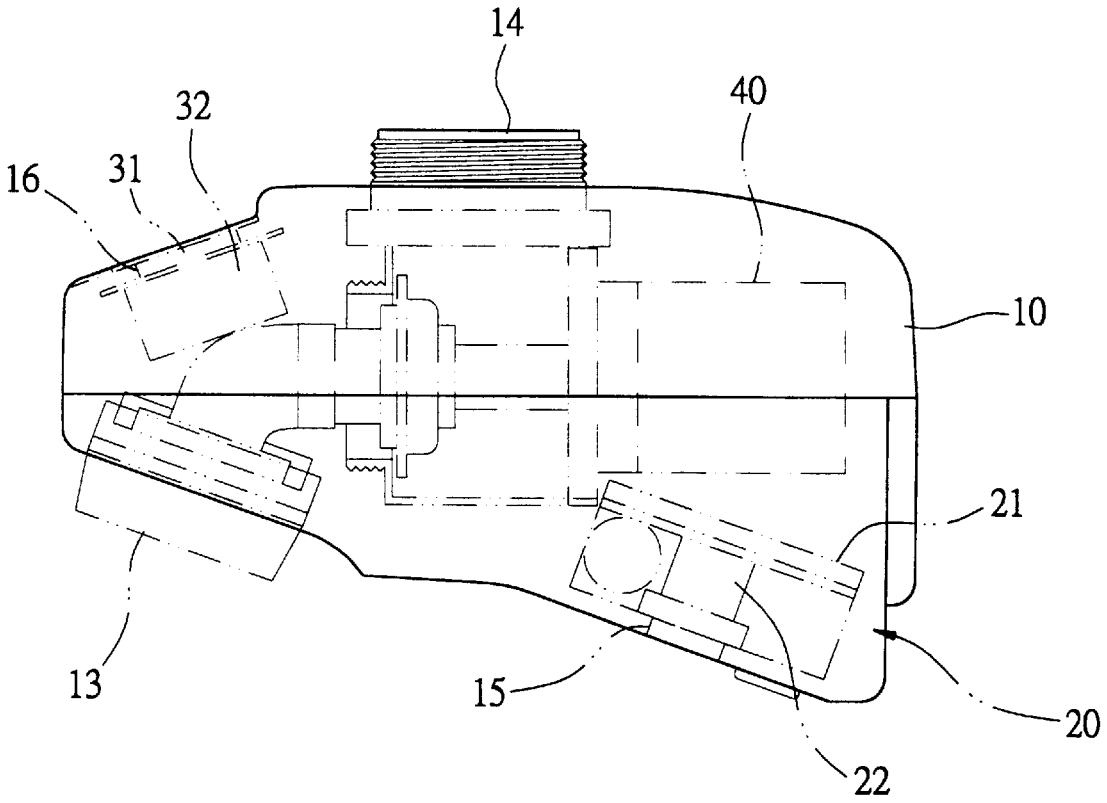
FIG. 2 is an illustrative view to show the switch device of the present invention.
Figure 3:
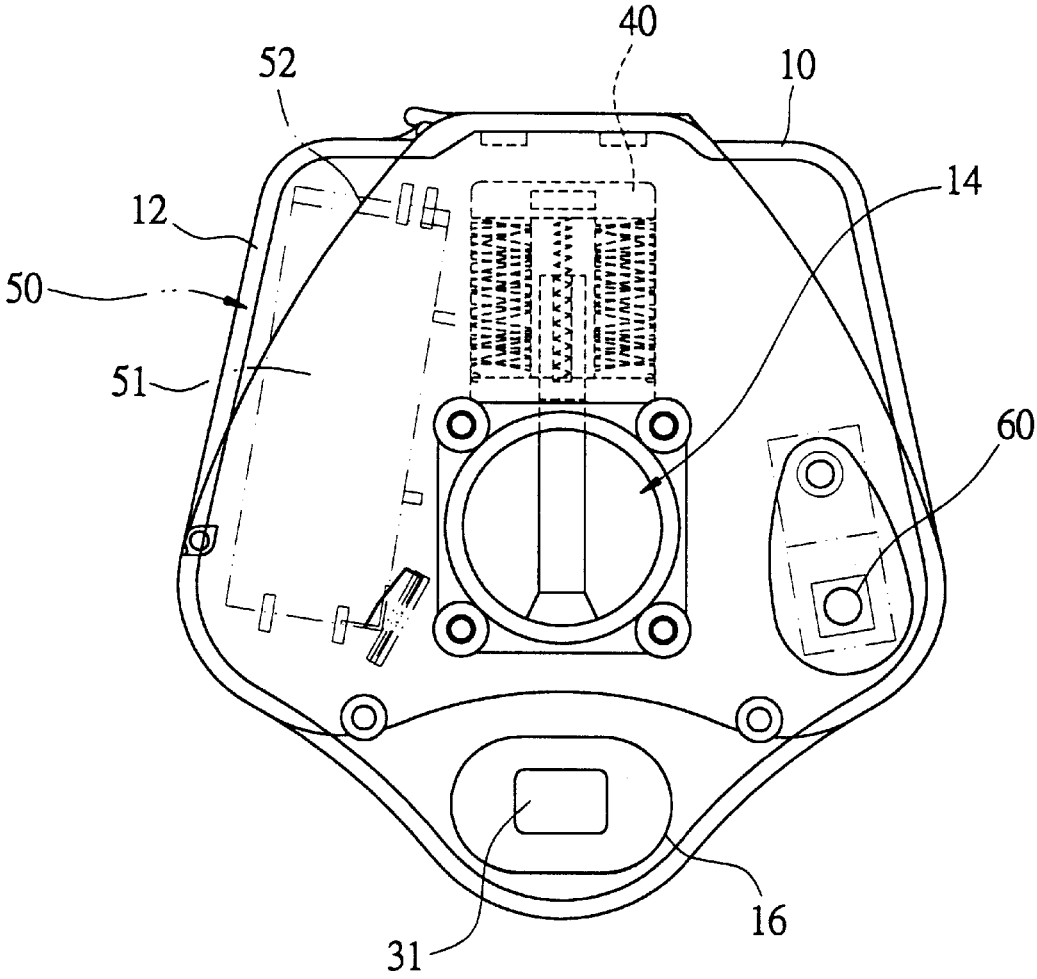
FIG. 3 is a top view to show the switch device of the present invention.
Figure 4:
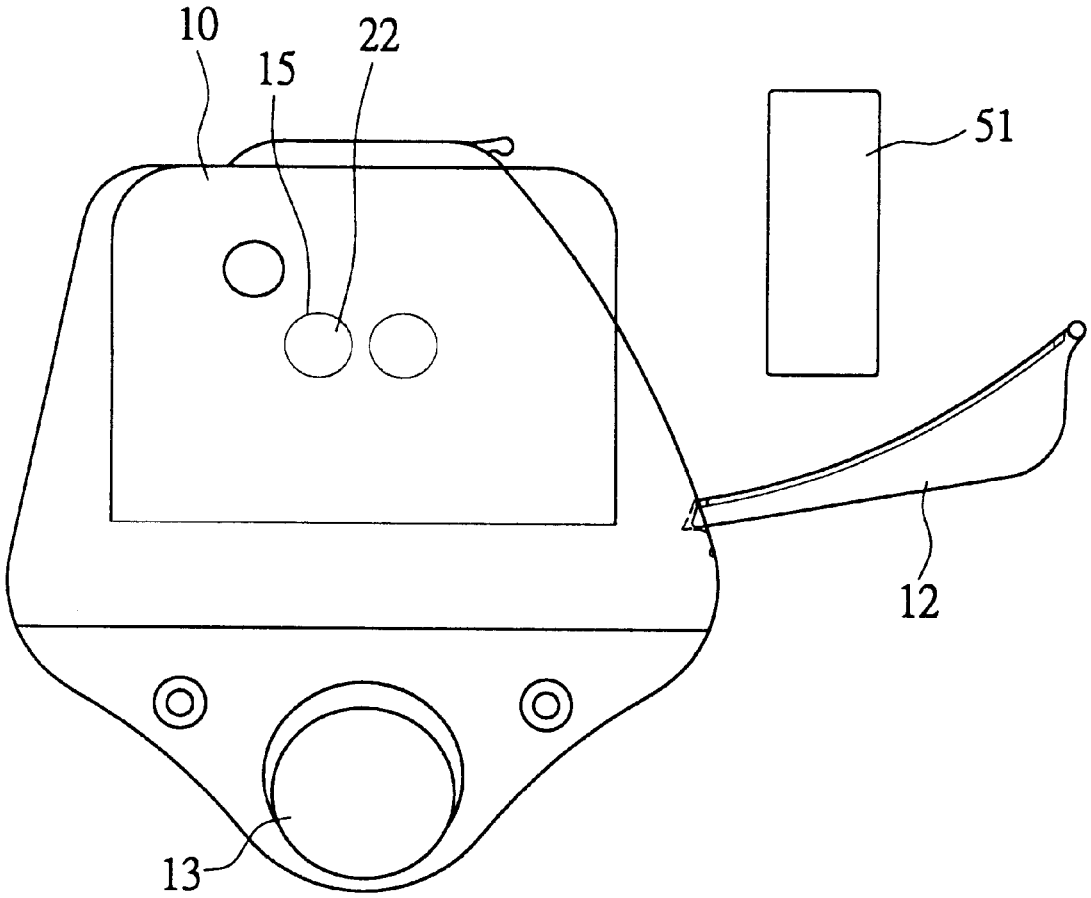
FIG. 4 is a bottom view to show the switch device of the present invention.

Referring to FIGS. 1 to 4, the switch device of the present invention comprises a casing 10 having a connection port 14 on a top surface thereof so as to be connected to a faucet 73 by a connection section 70 which will be described later. An outlet member 13 is located on an underside of the casing 10 and a solenoid valve 40 is received in the casing 10. The solenoid valve 40 is connected with the output member 13 by a pipe and the connection port 14 so that the solenoid valve 40 controls the water flowing to the outlet member 13. A battery chamber 50 (FIG. 3) is defined in a first side of the casing 10 and a cover 12 is pivotally closed the battery chamber 50. A battery set 51 supported on a support base 52 are received in the battery chamber 50. An infrared rays sensing device 20 is received in a second side of the casing 10 and a hole 15 is defined in the underside of the casing 10. The battery set 51 is connected to a circuit board 21 of the infrared rays sensing device 20. The hole 15 communicates with the infrared rays sensing device 20 so that a sensing member 22 of the infrared rays sensing device 20 emits an infrared ray from the hole 15.

A button 60 is connected to the top surface of the casing 10 and electrically connected to the solenoid valve 40. A thermometer 32 is connected on the top surface of the casing 10 and a liquid display board 31 is engaged with a hole 16 defined in the top surface of the casing 10 so as to display the temperature of the water.

Figure 5:
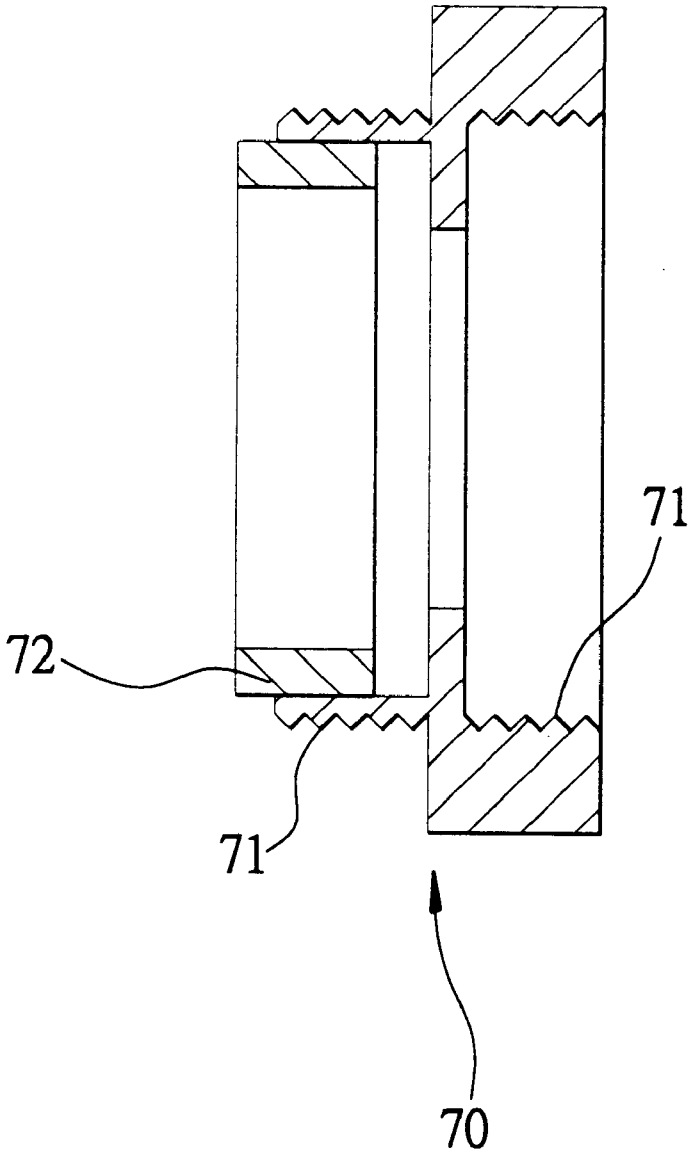
FIG. 5 is a cross sectional view to show a connection section of the switch device of the present invention.

As shown in FIG. 5, the connection section 70 has a threaded inner periphery 71 which is connected to the connection port 14 on the casing 10. A threaded section 71 extends from the connection section 70 and a seal 72 is received in an inner periphery of the threaded section 71 so that the threaded section 71 is connected to a threaded inner periphery of the faucet 73.

The switch device is compact in size and is able to connected to the faucet 73 externally so that it is convenient to be used in homes when an object is sensed by the sensing member 22 of the infrared rays sensing device 20, the solenoid valve 40 is activated to allow water to flow from the outlet member 13, and the water flow is stopped when the object is removed from the sensing member 22. The button 60 is designed to be touched to keep the water to flow continuously.

Figure 6:
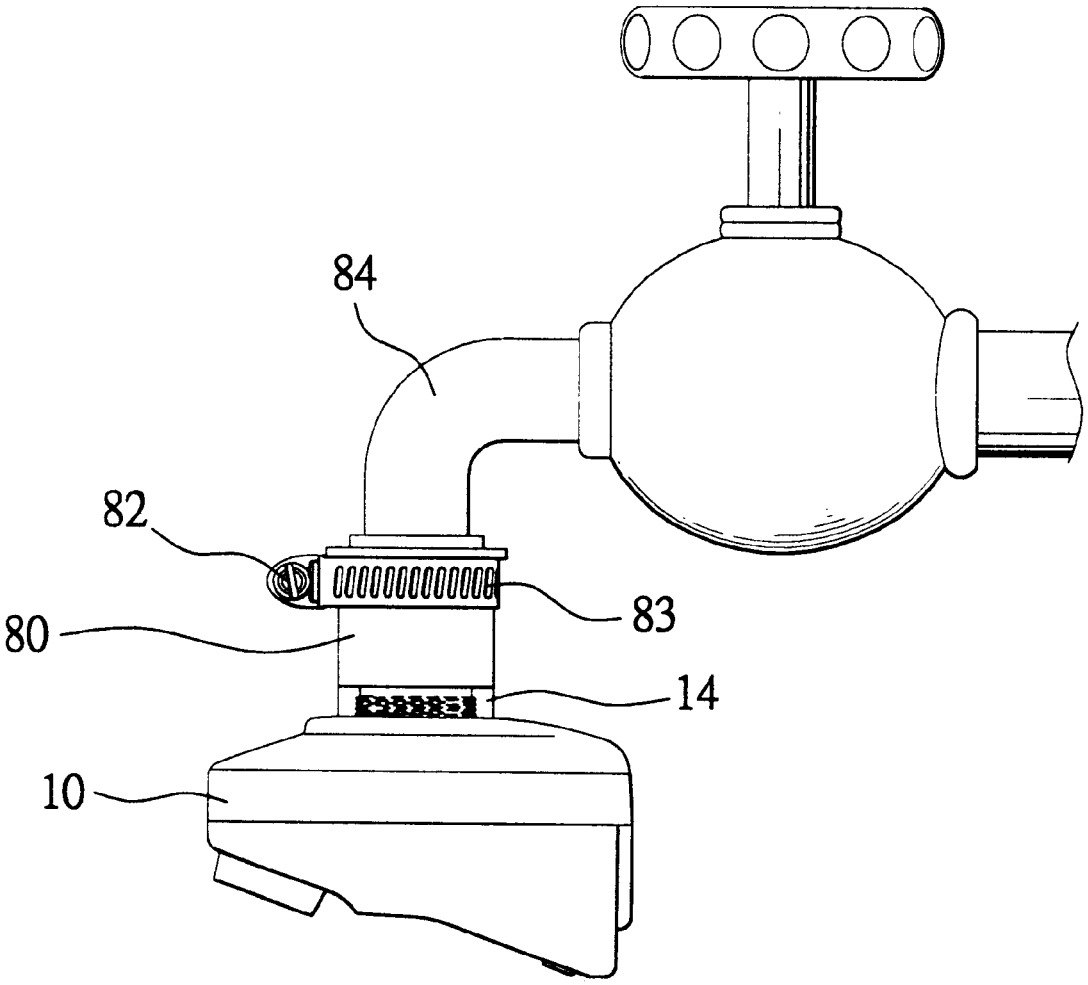
FIG. 6 is a side view to show that the switch device of the present invention is connected to another type of faucet.

Referring to FIG. 6, another type of faucet 84 has no threaded inner periphery to be connected to the connection section 70, a tube 80 is then used to connect the faucet 84 and the switch device. The tube 80 is connected to the connection port 14 at a first end thereof and a fastening strip 83 and a fastening bolt 82 are mounted to a second end of the tube 80 to securely connect the tube 80 to the faucet 84.

While we have shown and described various embodiments in accordance with the present invention, it should be clear to those skilled in the art that further embodiments may be made without departing from the scope and spirit of the present invention.

What is claimed is:

1. A switch device for a faucet, comprising:

a casing having a connection port on a top surface thereof and said connection port adapted to be connected to the faucet, an outlet member located on an underside of said casing, a solenoid valve received in said casing and connected with said outlet member, a battery set received in a first side of said casing and an infrared rays sensing device received in a second side of said casing, a hole defined in said underside of said casing and communicating with said infrared rays sensing device.

2. The switch device as claimed in claim 1 further comprising a button connected to said top surface of said casing and electrically connected to said solenoid valve.

3. The switch device as claimed in claim 1 further comprising a thermometer connected on said top surface of said casing.

4. The switch device as claimed in claim 1 further comprising a connection section having a threaded inner periphery which is connected to said connection port on said casing, a threaded section extending from said connection section and being adapted to be connected to the faucet.

5. The switch device as claimed in claim 1 further comprising a tube connected to said connection port at a first end of said tube and a fastening strip mounted to a second end of said tube.

6. The switch device as claimed in claim 1 further comprising a battery chamber defined in said first side of said casing and a cover pivotally connected to said casing and closing said battery chamber.

* * * * *